US005178395A

United States Patent [19]

Lovell

[11] Patent Number: 5,178,395

[45] Date of Patent: * Jan. 12, 1993

[54] DISPLAY DEVICE FOR THE PLAYING OF MULTIPLE GAMES SIMULTANEOUSLY

[76] Inventor: John G. Lovell, 3222 Ruby St., Knoxville, Tenn. 37922

[ * ] Notice: The portion of the term of this patent subsequent to Apr. 30, 2008 has been disclaimed.

[21] Appl. No.: 781,419

[22] Filed: Oct. 23, 1991

Related U.S. Application Data

[63] Continuation-in-part of Ser. No. 603,918, Oct. 26, 1990, abandoned, which is a continuation-in-part of Ser. No. 490,293, Mar. 8, 1990, Pat. No. 5,011,157.

[51] Int. Cl.[5] ..... A63F 3/06

[52] U.S. Cl. ..... 273/238; 273/269; 273/138 A; 273/144 R

[58] Field of Search ..... 273/237, 238, 269, 138 A, 273/144 R, 144 A, 144 B

[56] References Cited

U.S. PATENT DOCUMENTS

| | | |
|---|---|---|
| 2,594,434 | 5/1949 | Hofsetz . |
| 3,044,780 | 7/1962 | Silverman . |
| 3,118,677 | 1/1964 | Lang . |
| 3,300,217 | 1/1967 | Franklin . |
| 4,080,596 | 3/1978 | Keck et al. . |
| 4,218,063 | 8/1980 | Cooper et al. . |
| 4,274,638 | 6/1981 | Jullien . |
| 4,312,511 | 1/1982 | Jullien . |
| 4,332,389 | 6/1982 | Loyd, Jr. et al. . |
| 4,378,940 | 4/1983 | Gluz et al. . |
| 4,624,462 | 11/1986 | Itkis . |
| 4,655,461 | 4/1987 | Capri et al. . |
| 4,661,906 | 4/1987 | DiFrancesco et al. . |
| 4,732,392 | 3/1988 | Kerr et al. . |
| 4,747,600 | 5/1988 | Richardson . |
| 4,856,787 | 8/1989 | Itkis . |
| 4,875,686 | 10/1989 | Timms . |
| 4,909,516 | 3/1990 | Kolinsky . |
| 5,011,157 | 4/1991 | Lovell, Sr. et al. ..... 273/269 |

FOREIGN PATENT DOCUMENTS 2105996 4/1983 United Kingdom .

OTHER PUBLICATIONS

"Gambling Fever" Business Week Apr. 29, 1989 Issue-7 Pages.

*Primary Examiner*—V. Millin
*Assistant Examiner*—Jessica J. Harrison
*Attorney, Agent, or Firm*—Pitts and Brittian

[57] ABSTRACT

An electronic displaying device, together with a control unit and electronic circuitry appropriate to the encoding, sending, receiving, decoding, and displaying of data as used in various games, such as Bingo, Keno, or the like, in which a plurality of players may participate. In the exemplary game of Bingo, for instance, light-weight plastic balls, each marked with a letter and a number, are randomly selected and deposited into apertures in a console, by which action they are automatically identified through the breaking of one row and one column infra-red light beam of a coordinate grid of such beams. Through electronic encoding, transmitting, receiving, and decoding, the aforesaid letter-number combination is substantially instantaneously displayed in two places on a display board or a video monitor. The numbers are continuously selected and progressively displayed until a round of play has been completed in accordance with various rules of the game being played. When this occurs, the display board is cleared and all of the balls are reloaded to begin the next round of play. The console contains manually operated controls which affect the game data stored in memory and thus the display board, also.

10 Claims, 13 Drawing Sheets

| DEC. | HEX. $ | BCD | PULSE TRAINS (1=PULSE) 40 42 | DISPLAY | PULSE TRAINS (1=PULSE) 40 42 | DISPLAY | PULSE TRAINS 0=NO PULSE X=NO PULSE 40 42 | DISPLAY | PULSE TRAINS 40 42 | DISPLAY | PULSE TRAINS 40 42 | DISPLAY |
|---|---|---|---|---|---|---|---|---|---|---|---|---|
| 0 | 0 | 0000 | B | | I | | N | | G | | O | |
| 1 | 1 | 0001 | 0001X0001 | = B01 | 0010X0001 | = I16 | 0011X0001 | = N31 | 0100X0001 | = G46 | 0101X0001 | = O61 |
| 2 | 2 | 0010 | 0001X0010 | = B02 | 0010X0010 | = I17 | 0011X0010 | = N32 | 0100X0010 | = G47 | 0101X0010 | = O62 |
| 3 | 3 | 0011 | 0001X0011 | = B03 | 0010X0011 | = I18 | 0011X0011 | = N33 | 0100X0011 | = G48 | 0101X0011 | = O63 |
| 4 | 4 | 0100 | 0001X0100 | = B04 | 0010X0100 | = I19 | 0011X0100 | = N34 | 0100X0100 | = G49 | 0101X0100 | = O64 |
| 5 | 5 | 0101 | 0001X0101 | = B05 | 0010X0101 | = I20 | 0011X0101 | = N35 | 0100X0101 | = H50 | 0101X0101 | = O65 |
| 6 | 6 | 0110 | 0001X0110 | = B06 | 0010X0110 | = I21 | 0011X0110 | = N36 | 0100X0110 | = G51 | 0101X0110 | = O66 |
| 7 | 7 | 0111 | 0001X0111 | = B07 | 0010X0111 | = I22 | 0011X0111 | = N37 | 0100X0111 | = G52 | 0101X0111 | = O67 |
| 8 | 8 | 1000 | 0001X1000 | = B08 | 0010X1000 | = I23 | 0011X1000 | = N38 | 0100X1000 | = G53 | 0101X1000 | = O68 |
| 9 | 9 | 1001 | 0001X1001 | = B09 | 0010X1001 | = I24 | 0011X1001 | = N39 | 0100X1001 | = G54 | 0101X1001 | = O69 |
| 10 | A | 1010 | 0001X1010 | = B10 | 0010X1010 | = I25 | 0011X1010 | = N40 | 0100X1010 | = G55 | 0101X1010 | = O70 |
| 11 | B | 1011 | 0001X1011 | = B11 | 0010X1011 | = I26 | 0011X1011 | = N41 | 0100X1011 | = G56 | 0101X1011 | = O71 |
| 12 | C | 1100 | 0001X1100 | = B12 | 0010X1100 | = I27 | 0011X1100 | = N42 | 0100X1100 | = G57 | 0101X1100 | = O72 |
| 13 | D | 1101 | 0001X1101 | = B13 | 0010X1101 | = I28 | 0011X1101 | = N43 | 0100X1101 | = G58 | 0101X1101 | = O73 |
| 14 | E | 1110 | 0001X1110 | = B14 | 0010X1110 | = I29 | 0011X1110 | = N44 | 0100X1110 | = G59 | 0101X1110 | = O74 |
| 15 | F | 1111 | 0001X1111 | = B15 | 0010X1111 | = I30 | 0011X1111 | = N45 | 0100X1111 | = G60 | 0101X1111 | = O75 |

ENCODING SCHEME

Fig.3

DISPLAY DEVICE FOR THE PLAYING OF MULTIPLE GAMES SIMULTANEOUSLY

DESCRIPTION

This patent application is a continuation-in-part application based upon Ser. No. 07/603,918 filed Oct. 26, 1990, now abandoned, which is in turn a continuation-in-part application based upon Ser. No. 07/490,293, filed Mar. 8, 1990, and which issued Apr. 30, 1991 as U.S. Pat. No. 5,011,157.

TECHNICAL FIELD

The present invention relates to an electronic device for the display of numerical digits which are so arranged as to form letter-number coordinates such as those used in lottery games such as Bingo, Keno, Lotto, or the like, and more specifically concerns a system and devices for the encoding, transmitting, and displaying of not only such coordinate type data, but also data indicating the sequence in which each number was selected.

BACKGROUND ART

Various devices have heretofore been used to track and display, often in row-column coordinate form, certain randomly selected digits, as used in games such as Bingo, Keno, Lotto, or the like. Typically, in one exemplary embodiment, an operator makes a random selection of one ping-pong ball from among a number of similar balls, each one of which has been labeled with one of the five letters "B," "I," "N," "G," or "O," and a number between one and seventy-five, for example. In some instances, there may be no display of the selected numbers. In others, signs, lights, and video devices have been utilized for this purpose. In these situations, the usual format has consisted of five rows, each identified by a letter, matrixed with fifteen columns of numbers. Of course, it will be realized that other formats are equally possible, such as six rows of ten numbers per row with a middle divider between the third and fourth rows, for example. Regardless of the display format employed, however, after a number has been selected, the operator then announces such letter-number or row-column coordinate audibly, often over a public address system. Players subsequently use a marker to cover the grid location on a card which contains such announced coordinate location.

This action continues until one or more players has covered all of the grid locations in a particular predesignated pattern, at which time that round of play is terminated, the winner is awarded a prize, and a new round is begun. In large halls with many players, the need arises for large and/or multiple devices capable of continuously displaying in its appropriate location each row-column or letter-number coordinate pair called, while simultaneously displaying the same coordinate pair in the sequence in which it was called relative to other such coordinate pairs. Devices possessing this capability make possible the playing of at least two such lottery games simultaneously, one game, such as Bingo, for instance, depending on the attaining of enough coordinate pair locations to determine a winner, and another game, such as Keno, for instance, depending on the attaining of enough numbers in sequence matching those of the sequential display to determine a winner.

Prior art has included such devices as video cameras focussed on the last ball called and electronic memory storage for reconstruction of a set of digits in case of dispute or so-called "late" Bingo, but none of the previous methods has provided a truly automatic means of registering and indicating in a continuous fashion each selected coordinate pair simultaneously with the selection sequence. Cooper, et al, U.S. Pat. No. 4,218,063, teaches a masterboard with apertures and associated ball-actuated switches. However, ping-pong balls, specifically constructed to be as light as possible, lack the weight to satisfactorily actuate most mechanical switches; hence, the need for the present invention which generates a signal when a ping-pong ball, or any other opaque device, passes through beams of infra-red light. However, it can be seen that other methods of entering coordinate pair selection data into the system can be employed. Alternatively to the use of the ping-pong balls to automatically operate identifying switches as the selected balls are placed in apertures containing the switches, an operator can actuate such identifying switches manually. Such switches can include pluralities of push-button or toggle type switches, for instance, among others. Furthermore, a keyboard, such as the type used in conjunction with computers, could also be used to enter such selection data.

Loyd, Jr., et al, U.S. Pat. No. 4,332,389, teaches a last ball display but, in this device, the game would have to be stopped and the entire sequence of previously selected numbers stepped through, digit by digit, in order to see more of a sequence than merely the last ball called. The device of the present invention provides a display of at least the last fifteen numbers in the sequence in which they were selected, as well as the coordinate pair positional display. Of course, more or less numbers than fifteen could be utilized just as well in such a sequential order display system.

Accordingly, it is specifically an object of the present invention to provide a system and device to aid in the playing of a plurality of certain popular lottery games, such as Bingo, Keno, Lotto, and the like, simultaneously.

It is another object of the present invention to provide such a multiple game-playing device which will not only display the selected coordinate numbers in their assigned lettered rows in the sequence in which they were selected, but which additionally will provide a separate row to display the selected numbers solely on the basis of the sequence in which they were selected.

It is a further object of the present invention to provide such a multiple game-playing device which will accept, register, and encode for subsequent transmission any signal from any of a plurality of switch-type data entry mechanisms.

It is another object of the present invention to provide such a multiple game-playing device having a transmitting portion which will encode and transmit this coordinate and sequential data.

It is yet another object of the present invention to provide such a multiple game-playing device having at least one receiving-displaying portion, which can possibly be located at relatively great distances from the transmitting device, to receive, decode, and display such coordinate and sequential data.

It is still a further object of the present invention to provide such a multiple game-playing device having a display portion which displays the desired coordinate and sequential data in such a way as to be easily seen by the view even though such display portion can be separated from the viewer by a considerable distance.

Still another object of the present invention is to provide a device where the display means is a plurality of video monitors that display the row coordinate data and sequential data in an alpha-numeric or graphical fashion.

It is also an object of the present invention to provide such a multiple game-playing device which is able to utilize any or all, separately or simultaneously, of a plurality of data transmitting methods and/or protocols.

BRIEF DESCRIPTION OF THE DRAWINGS

Other objects and advantages of the multiple simultaneous game display will become apparent upon reading the detailed description, together with the following drawings, in which:

FIG. 3 contains a coding and number equivalency chart to diagrammatically illustrate an encoding scheme which could be utilized by the present invention.

DISCLOSURE OF THE INVENTION

Figure 1:
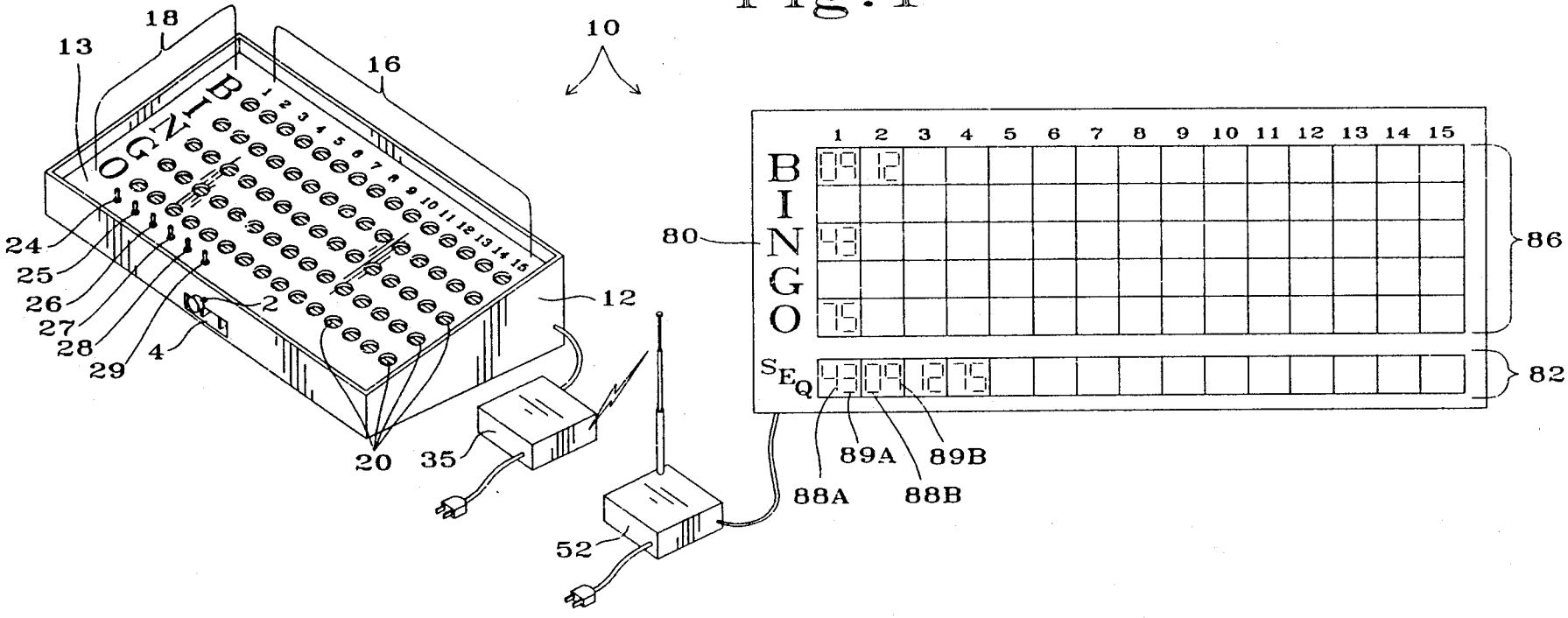
FIG. 1 depicts the major components of a multiple simultaneous game displaying system constructed in accordance with various features of the present invention illustrated generally at 10.
Figure 1A:
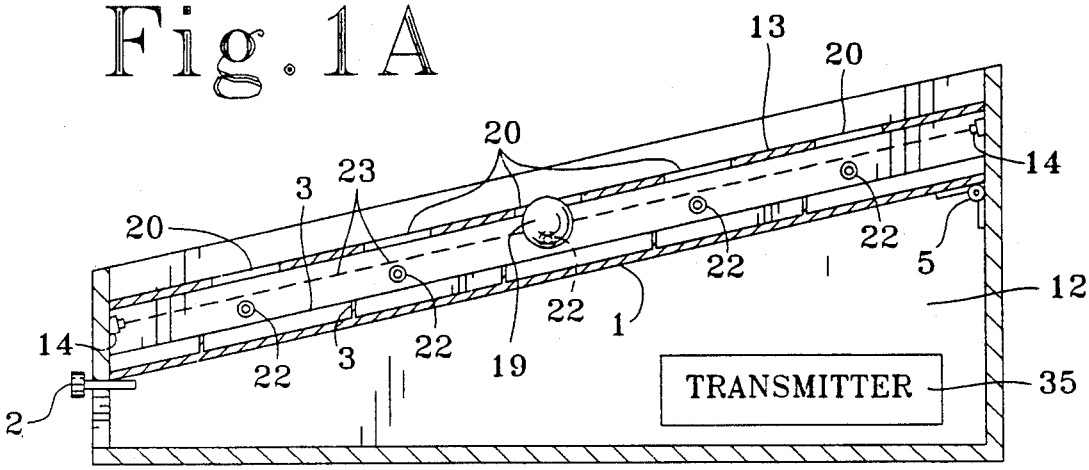
FIG. 1A is a sectional view of a transmitting portion of the present invention, illustrating some exemplary row and column identifying data entry switches.

In accordance with various features of the present invention, an electronic displaying device, together with a data input unit and electronic circuitry appropriate to the encoding, sending, receiving, decoding, and displaying of data as used in various games, such as Bingo, Keno, Lotto, or the like, is provided. This system is particularly designed to automate and display, in an unequivocal format, the pertinent information of certain popular lottery type games in such a manner as to allow more than one of such games to be played simultaneously, and will be described first in terms of its components and next, in connection with its operation.

In a preferred embodiment, a transmitting portion of a device constructed in accordance with various features of the present invention can be contained in any suitable housing having appropriate accommodations for the necessary inputs and outputs, such as a computer keyboard and external power, for example. Data transmission output can be accomplished wirelessly, as by an antenna, for instance, or through a cable or the building's electrical wiring, as well as other methods. A plurality of switches could also be associated with the transmitting portion, as by mounting thereon, for instance. For convenience, such switches could be arranged into five rows of fifteen, if desired. In any case, each input will indicate the letter, number, symbol, or combination imprinted on the ping-pong ball.

When a ping-pong ball is selected and the appropriate switch is operated responsively thereto to enter that fact into the transmission portion, that switch closure signal is encoded into a unique electronic signal code representative of that switch and the data imprinted on the ping-pong ball. This encoded electronic signal is sent to a receiver portion of the present invention operationally associated with a display portion thereof.

The receiver portion receives and decodes the encoded data into signals that are then displayed to present a graphical or numeric display of the data on a standard cathode ray tube (CRT), liquid crystal display (LCD) or similar video display monitor.

One embodiment of the display portion of the present invention comprises a preferably rectangular housing means constructed of some strong, rigid material, having a back cover and a front cover, which cooperatively enclose a volume. The front cover of this housing is comprised of a specially marked face plate hingedly attached thereto.

The face plate is made opaque except for fourteen slot-shaped transparent areas set in blocks of fifteen columns and six rows, two groups of seven such transparent slots to each block. Each group of seven transparent slots is arranged in the familiar configuration used by digital displays comprised of light emitting diodes (LEDs) or liquid crystal displays (LCDs). Instead of an LED, however, a light bulb, incandescent or fluorescent, for instance, is mounted behind each transparent slot. When the light bulbs proximate the appropriate segment areas are energized, a two digit number can be discerned as a result thereof.

Located within the housing and behind the face plate is an arrangement of substantially cubical compartments, each of which contains an electronic component board, with light bulb and socket configurations attached thereto. Within each of these compartments, which may also be called cells, a light-tight enclosure is provided around each particular light bulb and its associated transparent slot. When an electronic signal has been received, decoded, and sent to the appropriate cell component board causing a group of bulbs to be energized, the light from the bulbs is visible through the transparent portions of that area of the face plate, revealing the seven-segment characters thus outlined by such transparent portions.

The desired characters to be displayed on the display portion are arranged in a pattern corresponding to the labeling on the ping-pong balls as has been previously described. In the exemplary preferred embodiment, the top five rows are labeled, from top to bottom, "B, I, N, G," and "O." Each row will preferably contain fifteen two-digit numbers, appearing in the sequence in which they are selected. The B row will contain the numerals 01 to 15 inclusive; the I row will contain the numerals 16 through 30, the N row, 31 through 45, the G row will have 46 through 60, and the O row, 61 through 75. A sixth row, also comprised of two seven-segment digits in each of fifteen positions, will allow the last fifteen, for instance, digital pairs to be displayed in the sequence in which they were selected, concurrently with that number's display in the row-column positional display. It will be seen by those skilled in the art that fifteen is an arbitrary number and the actual number used can be either greater or smaller.

An alternative embodiment for the display would utilize a standard display driver that would convert the signals into the signal necessary to operate a standard video display such as a computer monitor and a compatible video monitor. Thus the above described data would be displayed on the monitor screen either graphically or as standard alpha-numeric characters.

In a preferred embodiment, the display portion is portable and capable of being suspended or self-supporting. Wheels and/or legs, suspension lugs, or other devices can be attached thereto. If carrier-current transmission is utilized, all signal and power input requirements are satisfied when the power cord is pluggably connected to a standard 115 VAC receptacle which is powered by the same power line transformer as the transmitter portion. However, it must be noted that other embodiments could include, for instance, the use of coaxial cable or any of various types of wireless transmission schemes for data signal input.

In use, a game operator would utilize a random selection means to select a ping-pong ball upon which had previously been imprinted a unique identification means, preferably a letter-number coordinate pair. Having selected a ball, the operator would enter the identification information into the device of the present invention, preferably via the previously described transmission portion. The signal generated thereby would be encoded and transmitted to a receiving-displaying portion where it would be decoded and converted into illuminated light bulbs which would display the number on an appropriate letter row and a non-letter sequential row simultaneously for reading and reference at any time by the players of the game or games. Alternatively, the signals would be displayed on the video display monitor in the appropriate letter row and a non-letter sequential row simultaneously for reading and reference at any time by the players of the game or games. Of course, other signals can be generated and other functions accomplished by attaching other switches and controls.

It will be immediately obvious to those skilled in the art that alternate embodiments of the present invention are possible. For instance, one such alternate embodiment could include the marking of the ping-pong balls with special ink and/or character designs or symbols suitable for reading with a Magnetic Ink Character Reader or an Optical Character Reader or some such like device. Data generated by such a device, however, would still need to be routed to the electronic circuitry for encryption and transmission in a manner similar to that which will be described in more detail in subsequent portions of this application.

BEST MODE FOR CARRYING OUT THE INVENTION

Referring to the drawings, wherein like numerals indicate like components, a device for the simultaneous playing of a plurality of selected games is indicated generally at 10.

In a preferred embodiment, a console 12 is provided which can be similar to a speaker's podium in appearance and/or construction. The upper surface 13 of console 12, inclined upwardly away from an operator, is perforated by a plurality of holes 20. The holes 20 are arranged in an exemplary embodiment in five rows 18, labeled "B," "I," "N," "G," and "O," of fifteen columns 16, numbered from "1" to "15." Thus, each hole 20 is uniquely identified by a letter-number coordinate pair, as "B 12," for instance.

A plurality of infra-red (IR) emitter-receiver pairs, or sets, is mounted on the interior walls of the console 12. In a preferred embodiment, there are twenty IR sets 14, one IR set 14 mounted in line with each one of the fifteen columns 16 of holes 20, and one set 14 mounted in line with each one of the five rows 18 of holes 20. Thus, each hole 20 is bisected in the Cartesian coordinate "X" plane by the light beam 22 of a row IR set 14, and in the "Y" plane by the beam 23 of a column IR set 14. All of the IR sets 14 are mounted so that their respective beams lie in two separate horizontal planes, with the plane of the column beams 23 being vertically separated from the plane of the row beams 22. Thus, any opaque object, such as a ball, 19 dropped into one of the holes 20 interrupts two infra-red light beams 22 and 23, one for a row 18, and one for a column 16, sending an appropriate identification signal to the electronic circuitry in transmitter 35.

An interior ball retention deck 1 is attached to an interior wall of console 12 by a hinge 5 and held in playing position by release lever 2. A grid of horizontal and vertical partitions 3 is attached to the interior walls of console 12 by a hinge 5 and held suspended flush against the upper surface of ball holding deck 1. When a ball 19 is dropped, it is preferably held by partitions 3 and deck 1 in its position until the game is finished. At that time, an operator can pull release lever 2, allowing the end of deck 1 proximate lever 2 to drop and release balls 19 through exit 4.

Figure 4:
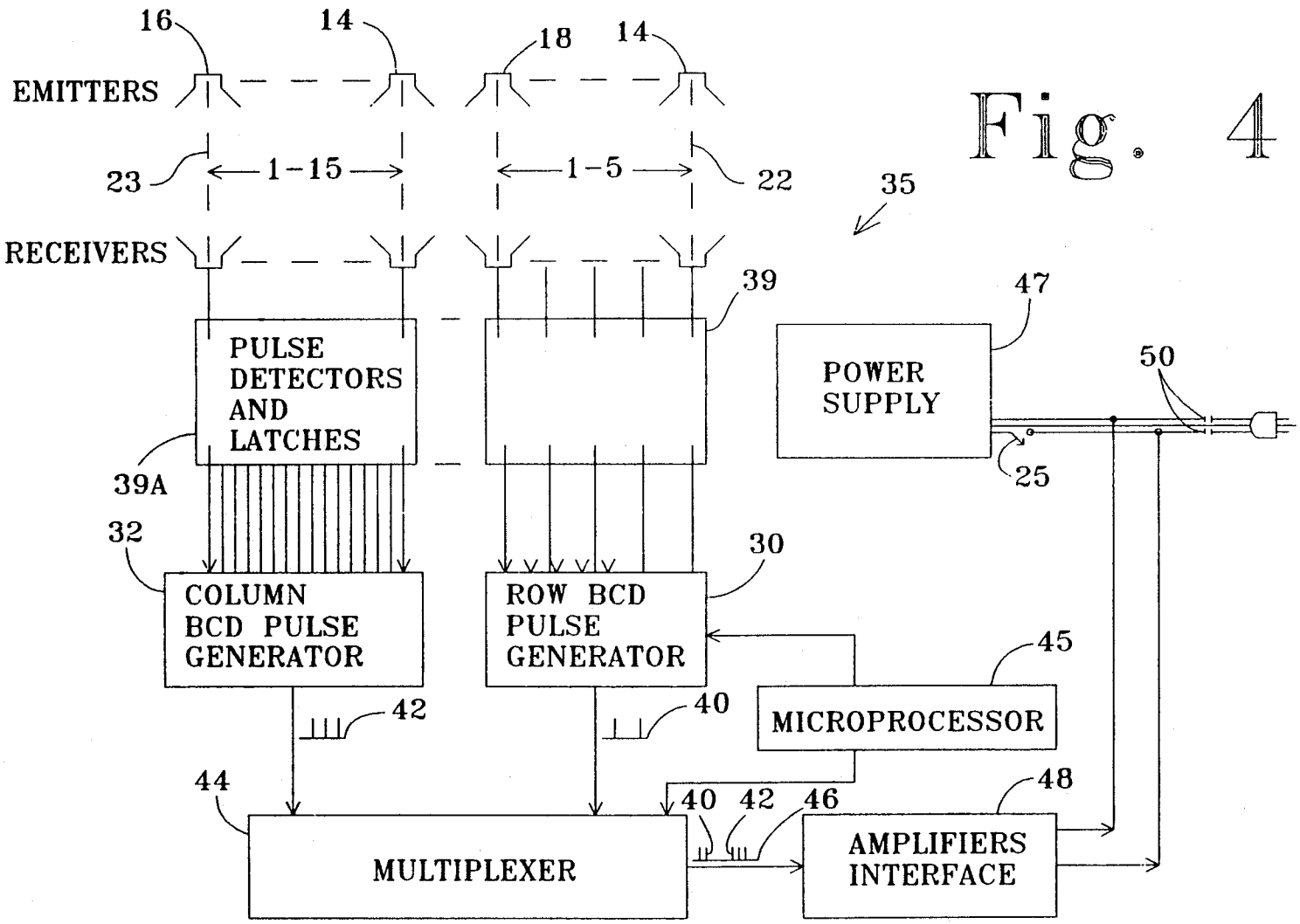
FIG. 4 is an illustration of a transmitting circuit block diagram which can be used as part of such a simultaneous multiple game-playing device.

As can be seen in FIG. 4, each IR light pair 14 of a row 18 is wired to a specific input terminal of row BCD pulse generator 30 through detector/latches 39. In like manner, each IR light set 14 of a column 16 is wired to a specific input terminal of column BCD pulse generator 32 through pulse detector/latches 39A. In a preferred embodiment, pulse generators 30, 32, and latches 39, 39A, are integral parts of transmitter 35, inside console 12.

Pulse generators 30 and 32 generate sequences, or trains, of pulses which are unique for each input terminal. In this manner, any interruption of an IR light beam 22 of any IR set 14 of any row 18 will cause the generation of a pulse train 40 that is uniquely encoded to that particular row 18. Likewise, any interruption of an IR light beam 23 of any IR set 14 of any column 16 will cause a pulse train 42, uniquely coded to that particular column 16, to be generated by the column BCD pulse generator 32. The pulse trains 40, 42, so generated are routed to a multiplexer 44 for combining and sequencing into a serial format pulse train 46. Microprocessor 45 times and coordinates the operation of the encoding and transmitting section, and power supply 47 is a standard state of the art five Volt DC supply.

After multiplexing at 44, the pulse train 46 is amplified by a conventional power amplifier 48 and capacitively coupled 50 into the building's AC supply voltage line in one embodiment, known as carrier-current transmission. However, it will be seen by those with expertise in the field that any transmission means could be utilized, including but not limited to, coaxial cable, fiber-optic cable, laser light, infra-red light, and/or wireless radio, via any type of modulation desired.

Regardless of the transmission method utilized, the row-column information corresponding to the interruptions of specific light beams 22, 23, is encoded in the pulse train 46 in accordance with the chart of FIG. 3. Referring to FIG. 3, the encoding method used in one embodiment of the present invention is of the type known as binary coded decimal (BCD) which uses four positions of Base 2 numerical values to represent sixteen different four digit numbers, from zero to fifteen. The presence of a one (represented electronically by a positive voltage pulse) equals the presence of a value in a particular position. In the decimal (Base 10) system, a one in the right hand-most place equals the presence of the value of one (ten to the zero power). In the BCD system, a one in the right hand-most position also equals a one but it is two to the zero power in this case. Just as each place progressively to the left in the decimal system equals ten to an increased power (10 to the first power=10), (ten squared=100, ten cubed=1000, etc.), so each place progressively to the left in the BCD system equals two to an increased power, i.e., two to the first power=two, two squared=four, two cubed=eight. Thus, the four positions of a four-digit number would indicate the presence or lack of an eight, a four, a two, or a one, reading from left to right.

The values represented by the presence of ones (pulses) are added together to determine the decimal equivalent. Therefore, the value of one is represented in BCD as 0001, five is represented by the value for four plus the value for one, as 0101, twelve is 1100 (8+4+0+0), thirteen is 1101, etc., as illustrated in the chart of FIG. 3. A one in each of the four positions will be seen to total fifteen. The absence of a pulse (or one), of course, represents zero.

A modification of the BCD code has been devised which permits converting of the double digits between ten and fifteen into single digits. This code is called hexadecimal code. In the hexadecimal code, the letters A through F represent the digits ten through fifteen, respectively. Conventionally, hexadecimal coded numbers are prefixed by the dollar sign, $, in notation. Thus, as utilized by the present invention, the digits one through nine in the decimal system are the same as $1 (read "hex one" ) through $9 ("hex nine") in the hexadecimal system, and are written 0001 through 1001 in BCD. However, the difference between the two systems, begins with $A ("hex A") in hexadecimal, written 1010 in BCD, which is ten in the decimal system, as illustrated in FIG. 3.

In the present invention, a "word" of encoded information consists of an eight-bit "byte," which is made up of two four-bit "nybbles." The left-most four-bit nybble represents a row code, and column codes are represented by the right-most four-bit nybble. The two nybbles are separated by a space, or pause in transmission.

Because there are only five rows to be encoded, these five left-most addresses can be represented by 0001 through 0101 Base 2, leaving the values eight through twelve (Base 10) (1000 through 1100 Base 2) free to be used to encode other things, such as signals from control switches on the console, for instance. Therefore, this has been done for five switches in the present invention as follows:

1000 xxxx=Cancel Last Entry Switch 26
1001 xxxx=Reset/Clear Board Switch 28
1010 xxxx=Replay Sequence/Check Sw. 27
1011 xxxx="Next" Switch 29
1100 xxxx=Cancel Replay/Restore Board Switch 24

The right-most half 42 of the serial pulse train 46, indicated by "x"s and separated from the left-most half 40 by a blank position one pulse width wide, is used to indicate the number (column) address of a selected coordinate pair. These four positions are created in the same manner as the first four, except that the pulses filling these positions are generated by the column generator 32 instead of the row generator 30. These four pulse positions are used to represent seventy-five numbers by using each group of fifteen column codes with a different row code. Each combination, therefore, is made to represent one of five different values, depending on which row code train is used with it. In this manner, the same fifteen codes which would equal one (0001) to fifteen (1111) when used with a "B" row code (0001), would equal sixty-one to seventy-five when used with an "O" row code (0101). Thus, 0001 1111 would equal B 15, and 0101 1111 would equal O 75.

Figure 5:
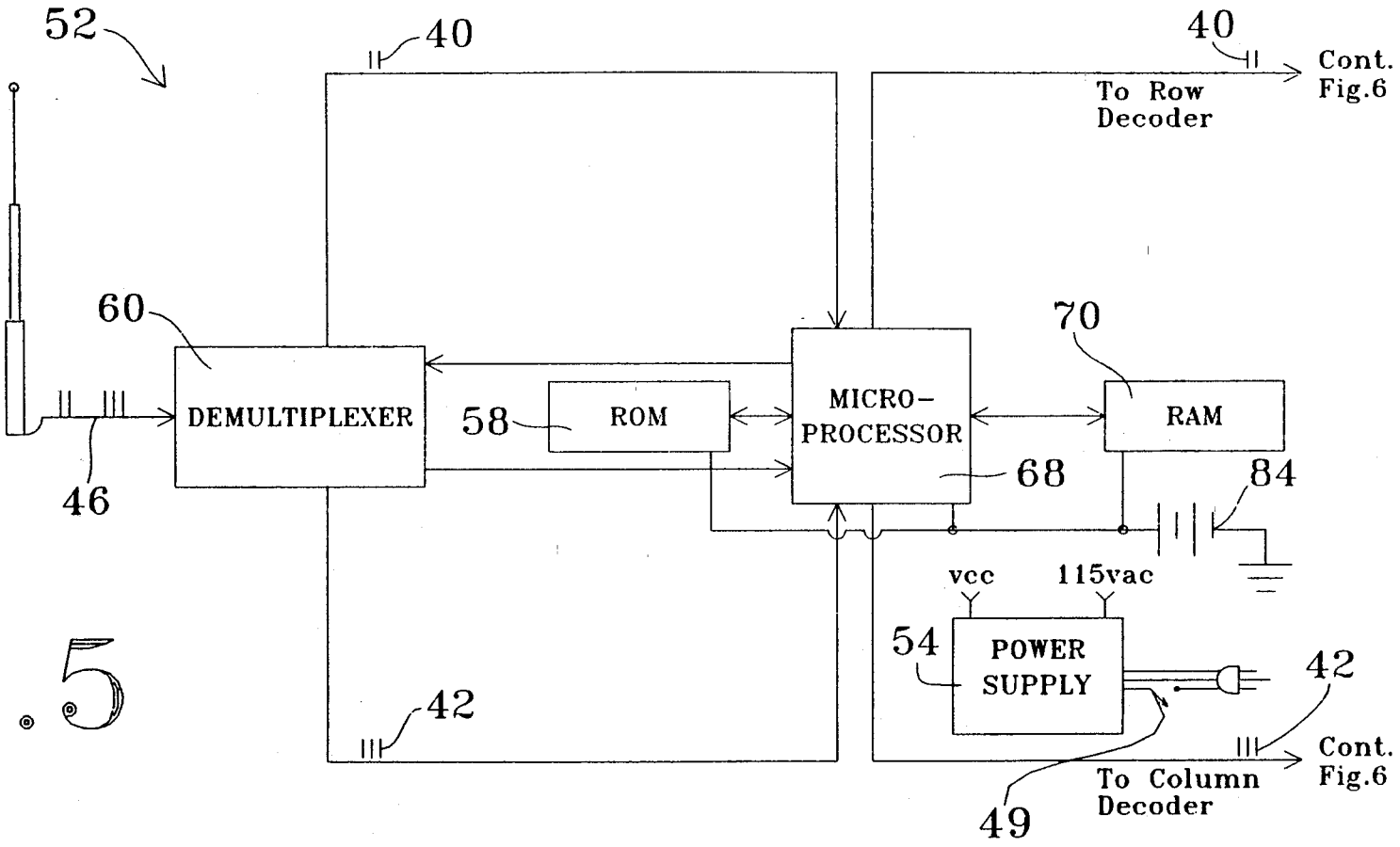
FIG. 5 is a block diagram of a receiver circuit which can be used as part of the present invention.
Figure 6:
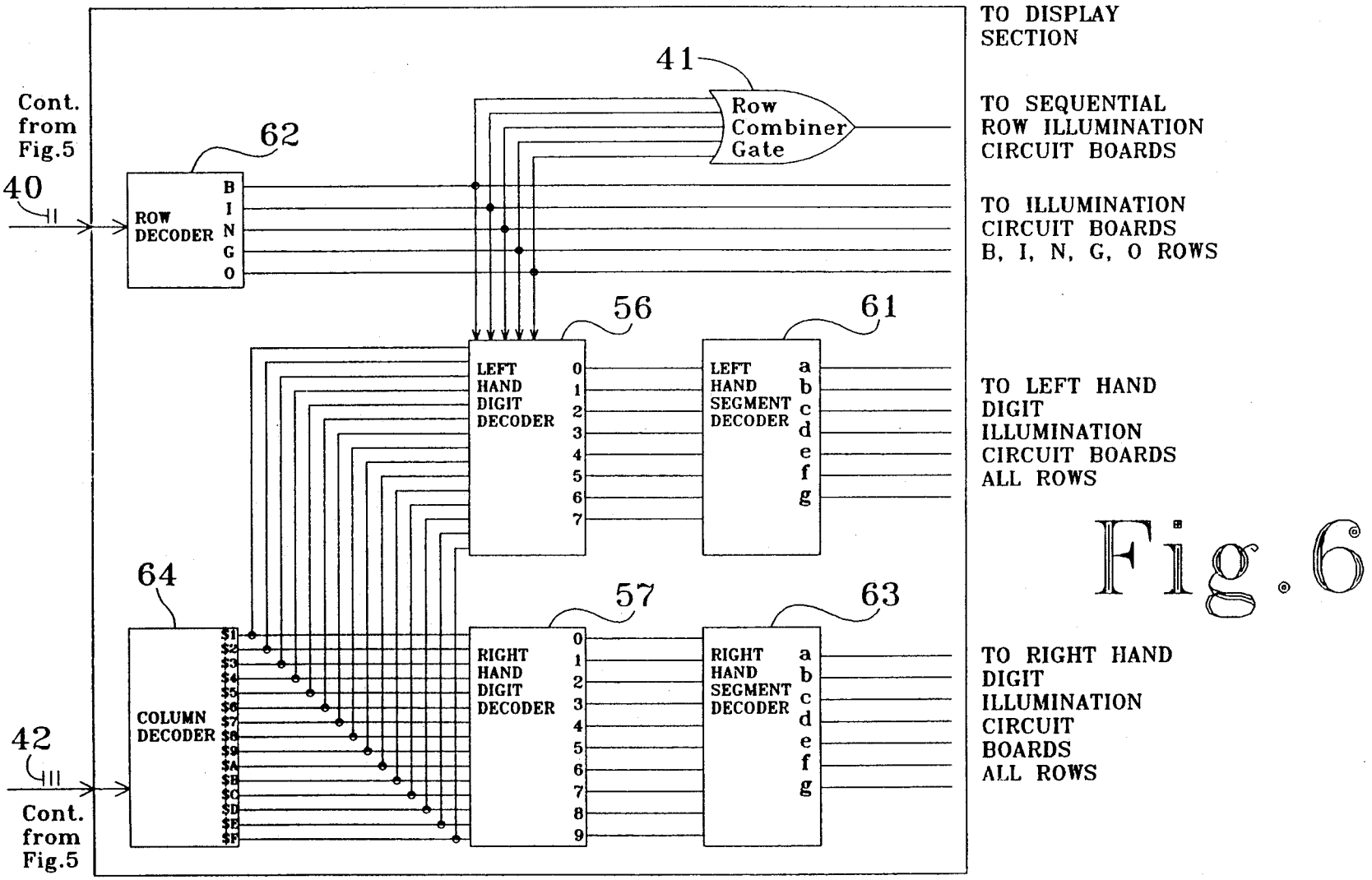
FIG. 6 is a block diagram of a decoding circuit which can be used as part of the present invention.
Figure 9:
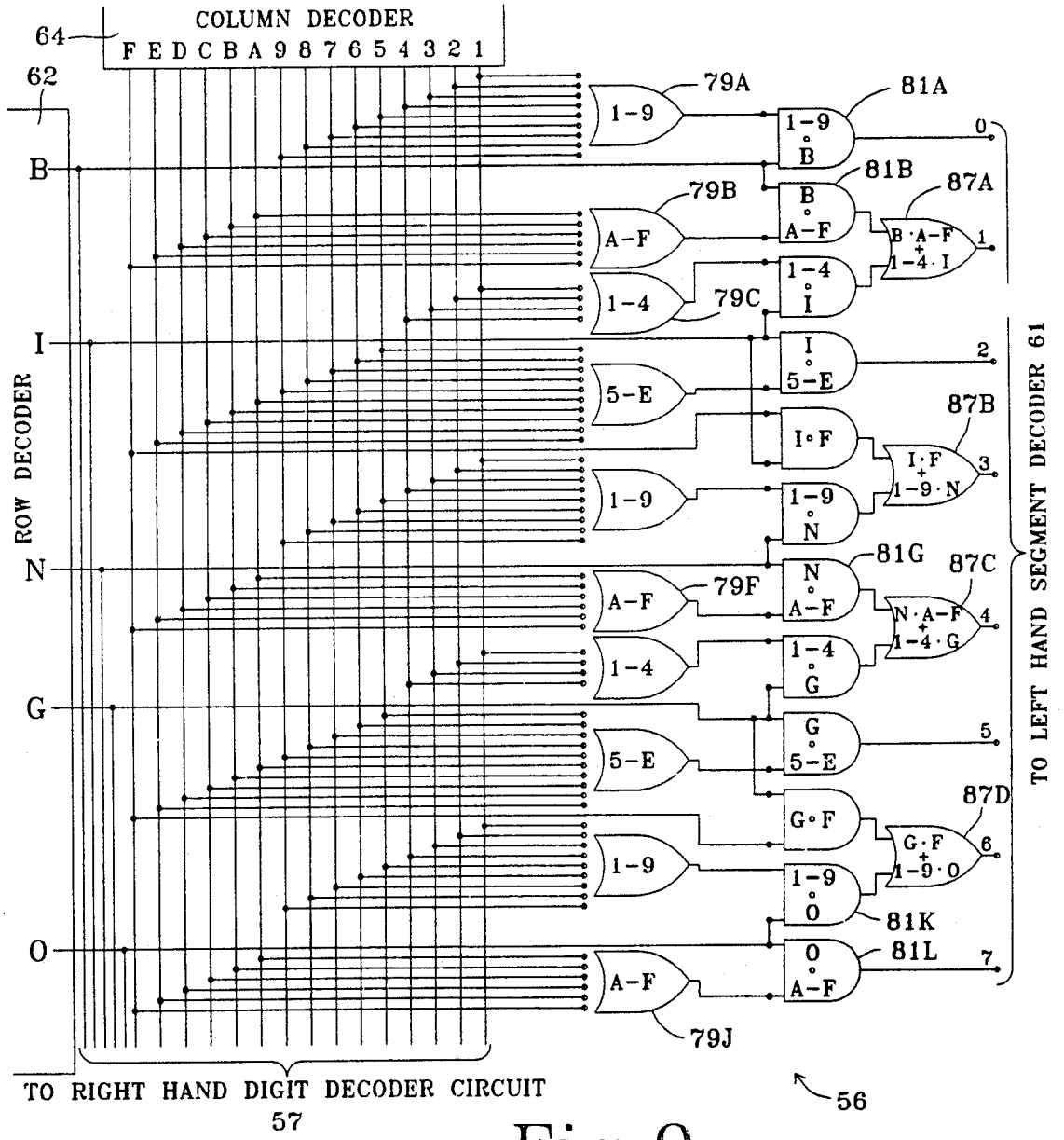
FIG. 9 is a block diagram of a left-hand digit decoder circuit portion of a decoding circuit such as that in FIG. 6.
Figure 10:
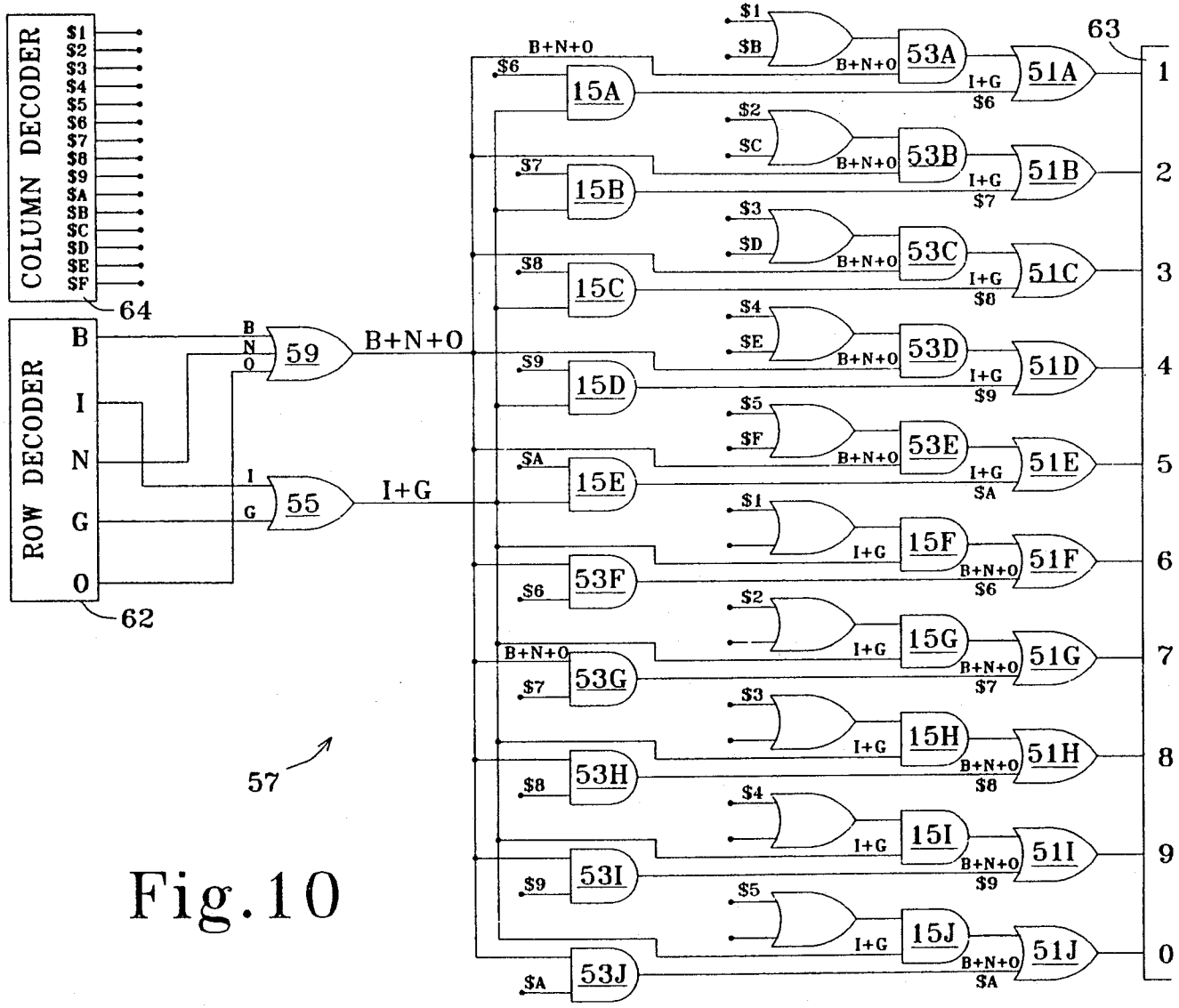
FIG. 10 is a block diagram of a right-hand digit decoder circuit portion of a decoding circuit such as that in FIG. 6.

In FIG. 5, the combined serial pulse train 46 is shown being received by receiver 52. After this pulse train has been demultiplexed at 60, row pulse train 40 and column pulse train 42 are fed to the microprocessor 68 for processing, storage in Random Access Memory (RAM) 70, and then on to the decoding section in FIG. 6. The pulse train data entered into microprocessor 68 is sent to RAM 70 and stored so that if a power failure should occur, microprocessor 68 and the "keep-alive" battery 84 will ensure that the data in RAM 70 is saved. After power has been restored, "Cancel Replay/Restore Board" switch 24 on the console 12 can be activated to send the "restore" pulse train signal to the microprocessor 68 so it will return the display board 80 to the status existing at the time of the power outage. Read Only Memory (ROM) 58 contains the previously stored program of commands which controls the actions of microprocessor 68. Power supply 54 supplies the five Volts DC for the entire display board 80, and also all the 115 Volts AC, which is switched by an internal relay, not shown. Power for display board 80 is supplied through the power on/off switch 49. In FIG. 6, row pulse train 40 and column pulse train 42, after having passed through the microprocessor 68, are routed to row decoder 62 and column decoder 64, respectively. Block diagrams of these circuits are shown in FIGS. 9 and 10, and a more detailed explanation of their operation follows later.

In the decoding section shown in FIG. 6, the pulse trains are translated in row decoder 62 and column decoder 64 into single pulses on the output lines appropriate to the input signal. For instance, "N 43" would become a pulse on the "N" output line of the row decoder 62, and a pulse on the "$D" output line of column decoder 64. The outputs of both of these decoders go to the left- and right-hand digit decoders, 56 and 57, respectively. In addition, parallel outputs from row decoder 62 are routed to the appropriate digit illumination boards 90*x* as row selector signals. Row combiner gate 41 is an OR gate which provides a row select signal to the sequential display "S" row digit illumination boards 90S no matter which of the other rows is selected.

Figure 2:
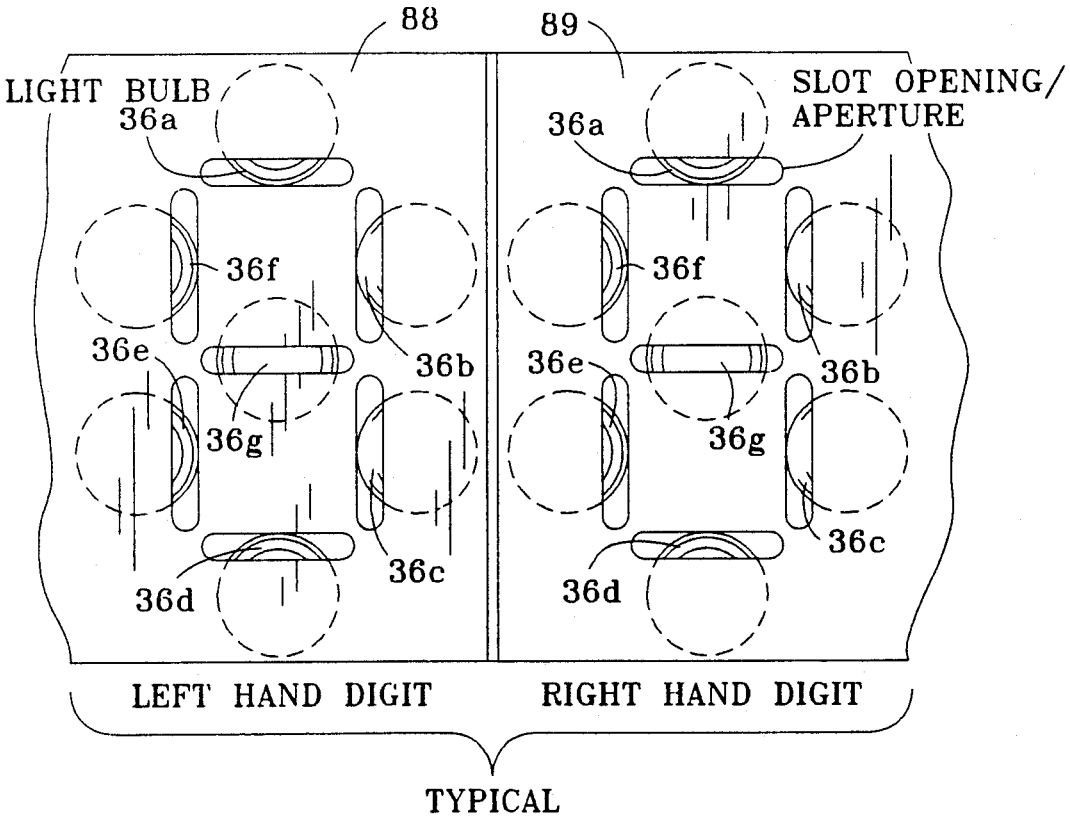
FIG. 2 is a drawing of a method of creating seven segment display digits by the use of light bulbs and oblong-shaped transparent areas of a display face plate.

The eight output lines corresponding to the numerals zero through seven from left-hand digit decoder 56 carry signals to the left-hand segment decoder 61. Similarly, the ten output lines corresponding to the numerals zero through nine from the right-decoder 57 carry signals to the right-hand segment decoder 63. To continue the use of the analogy "N 43," a pulse would be present on the "4" line of the left-hand digit decoder 56, and on the "3" line of right-hand digit decoder 57, as well as on the "N" line of row decoder 62. The segment decoders, 61, 63, convert input pulses into pulses on the output lines to cause the illumination of the correct segments of a standard seven segment display, as illustrated in FIG. 2. The output of the left-hand segment decoder 61 would be a pulse on each of the "b," "c," "f," and "g" segment lines for a "4," and a pulse on each of the "a," "b," "c," "d," and "g" lines of the right-hand segment decoder 63 for a "3."

Figure 7:
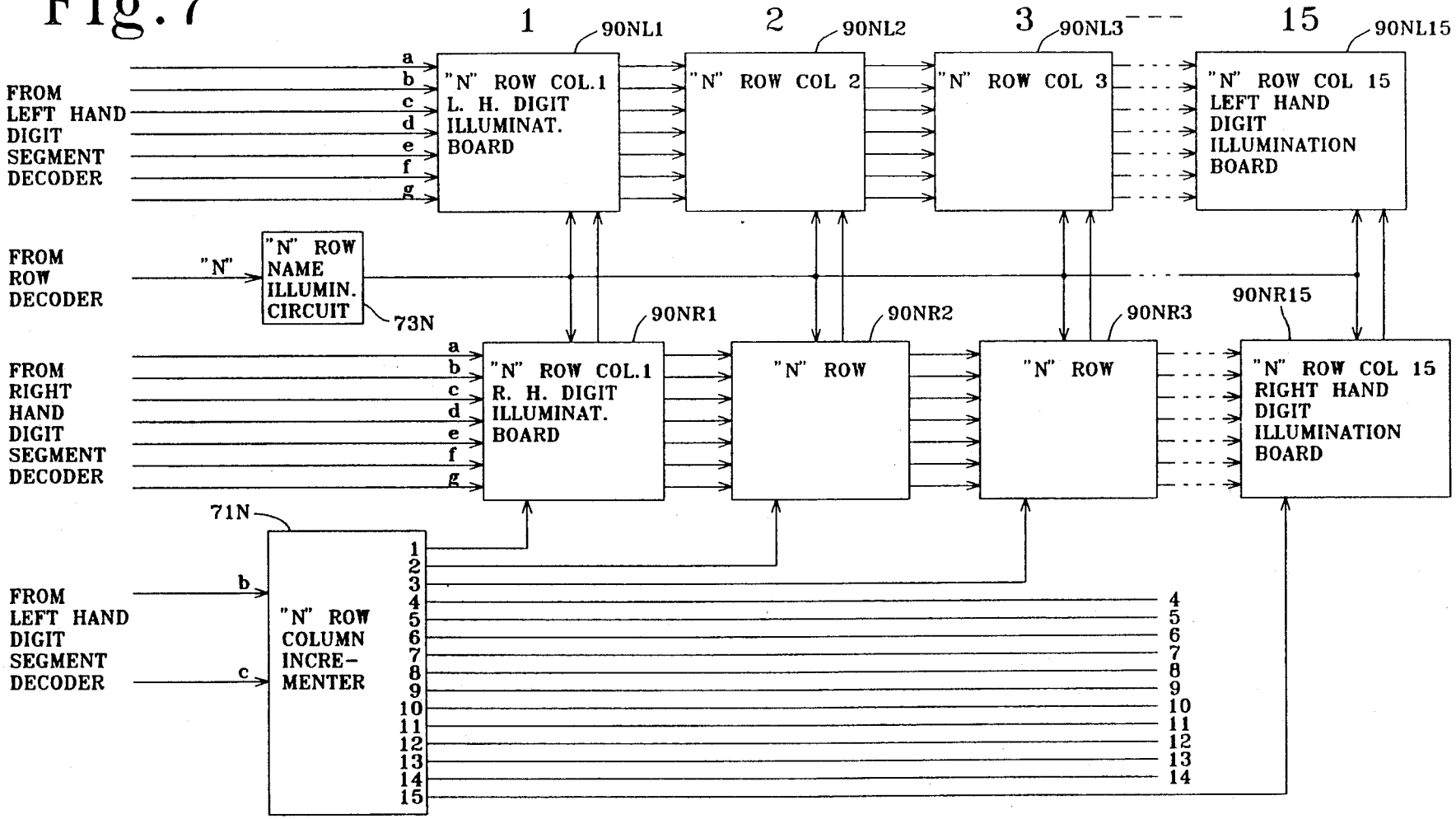
FIG. 7 is a block diagram of a display circuit which can be used as part of the present invention.

The row signal from row decoder 62, the signal from row combiner gate 41 to the "S" row, the pulses on the appropriate output lines of segment decoders 61 and 63, are all routed to the digit illumination board 90*x*, in the display section, illustrated in FIG. 7.

Figure 11:
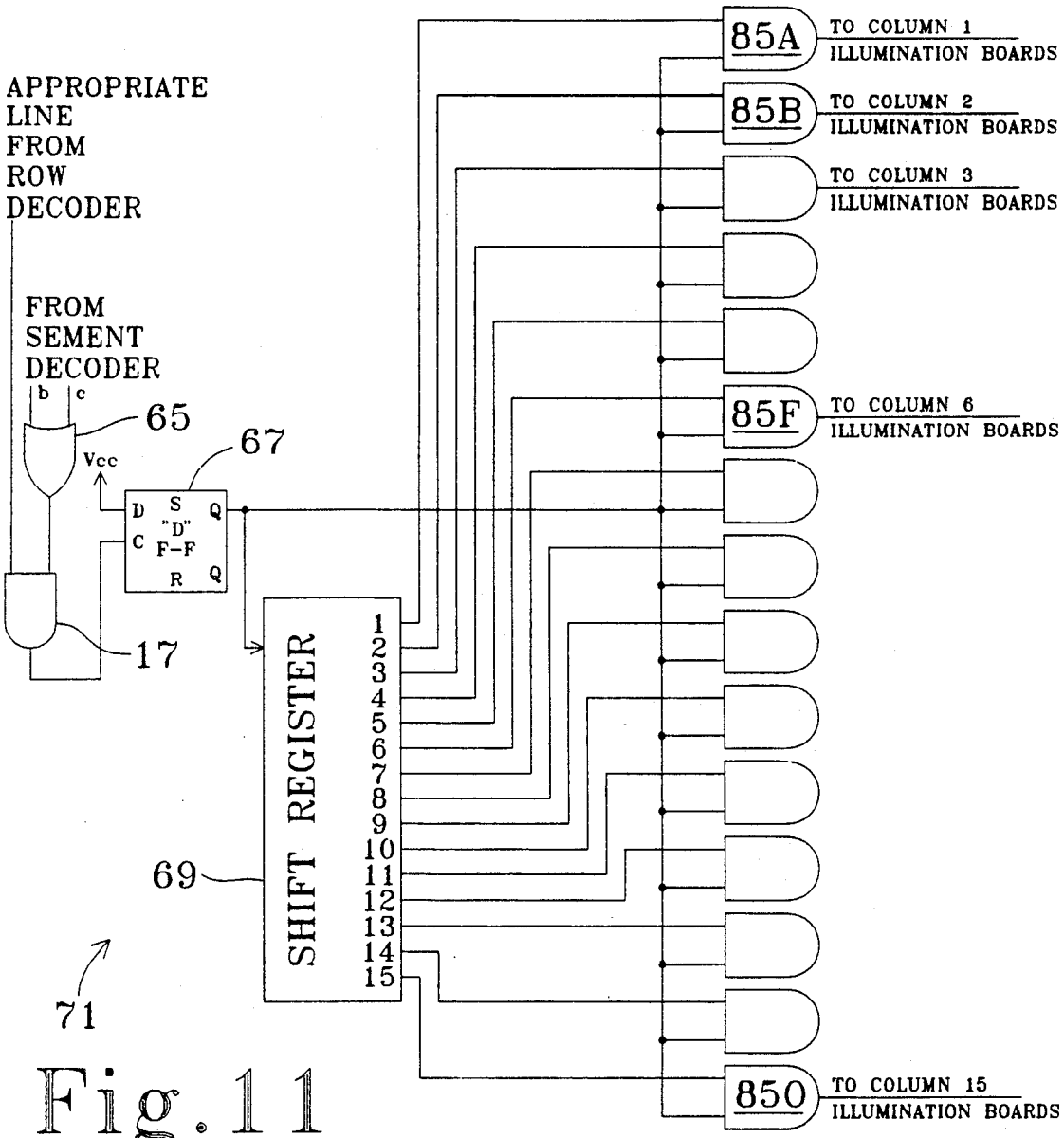
FIG. 11 is a block diagram of a column incremented circuit portion of a decoding circuit such as that in FIG. 6.
Figure 12:
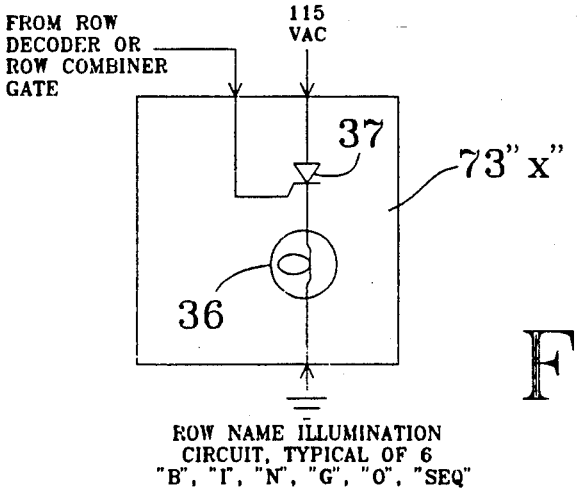
FIG. 12 is a block diagram of a row name illumination circuit portion of a decoding circuit such as that in FIG. 6.
Figure 13:
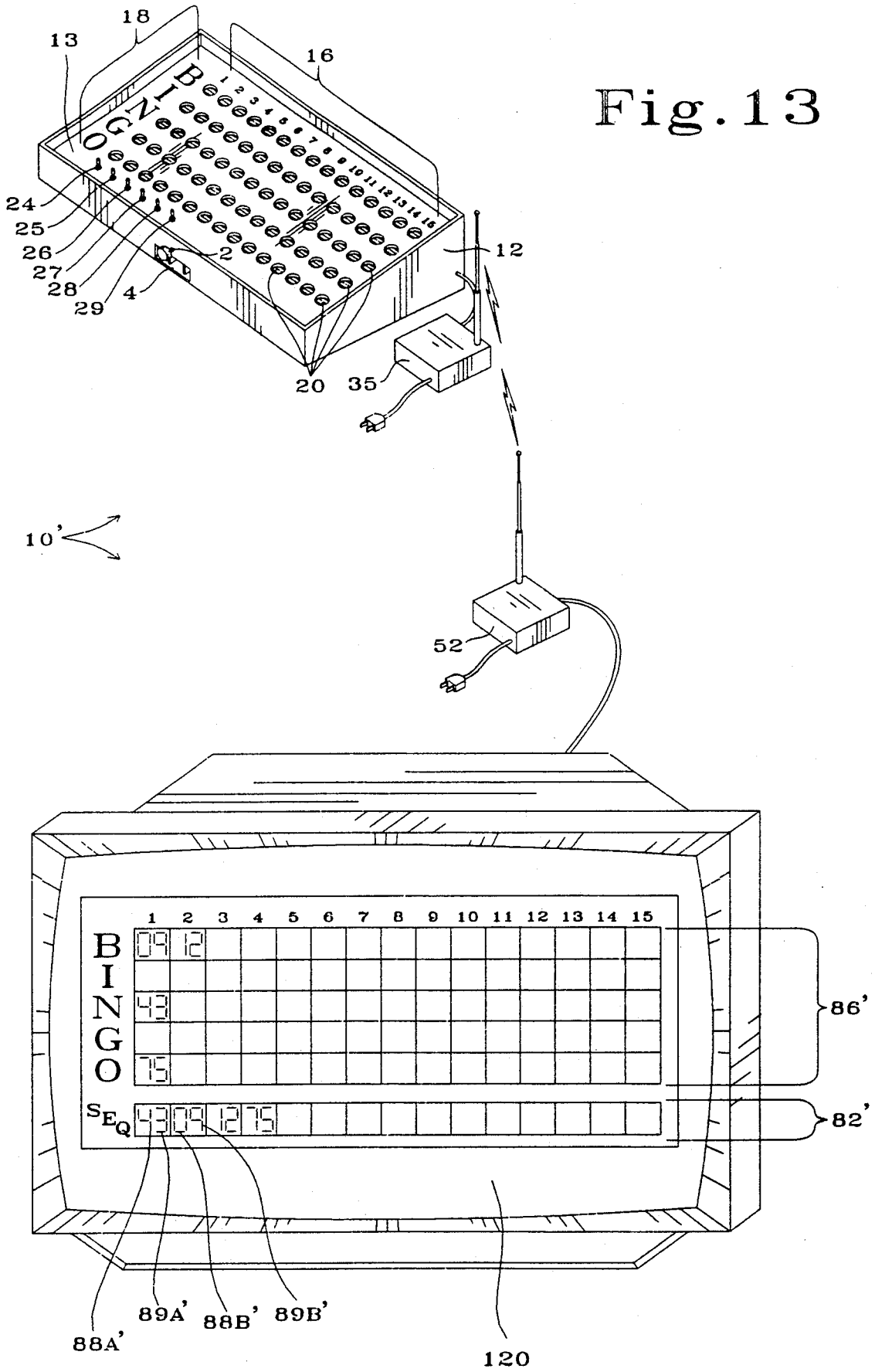
FIG. 13 is an illustration of the major components of a multiple simultaneous game displaying system constructed in accordance with various features of the present invention showing the alternate embodiment wherein the displaying device is a video monitor.

Referring to FIG. 7, the row select signal for the "N" row is shown being applied to the row name illumination circuit 73N. This lights the bulb behind the letter "N" of that row on display board 80. A detailed view of the row name illumination circuit is shown in FIG. 12 and a more detailed explanation of that circuit's operation follows later. The row select signal is also conducted to each of the 30 digit illumination boards 90*x* on each row. In FIG. 7, only eight representative boards of one row are shown for reasons of space. Because every seven segment digit used requires either the segment "b" or the segment "c" in its structure, the "b" and "c" segment decoder output lines are also wired to the column incremented 71*x* on each row. Thus, after a number has been entered in a particular column of a particular row, each new number to be displayed on that row is moved to the next column to the right through the use of the "b" or "c" segment pulse as an indication of the presence of a new digit. A block diagram of the column incremented 71 is shown in FIG. 11 and a more detailed explanation of this circuit follows later.

Figure 8:
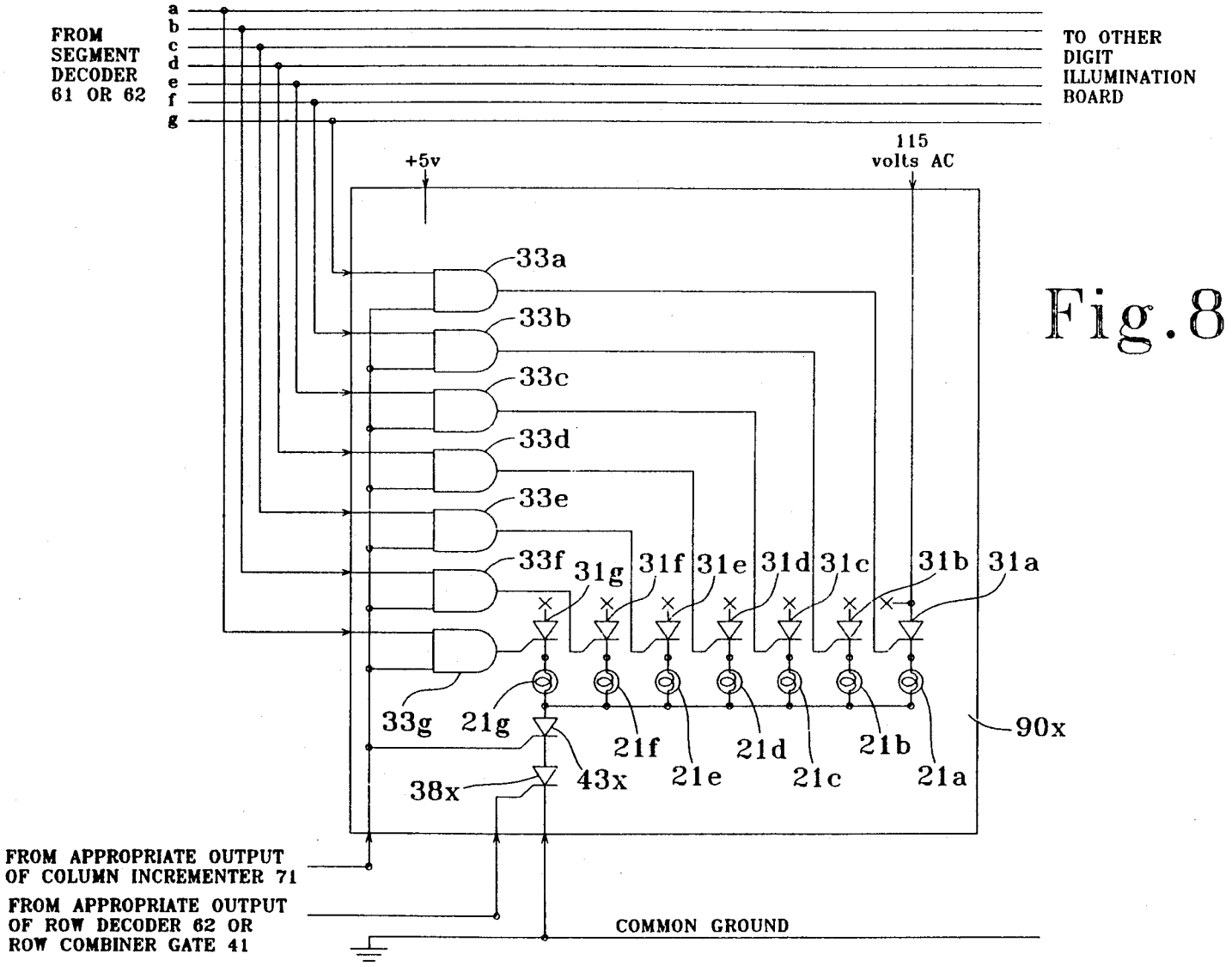
FIG. 8 is a block diagram of a digit illumination circuit portion of a decoding circuit such as that in FIG. 6.

A block diagram of the digit illumination circuit board 90*x* is shown in FIG. 8. The 115 Volts AC potential is wired to each of the silicon controlled rectifiers (SCR) 31 which are essentially open circuits until biased into conduction by pulses on their gate electrodes. Pulses on the segment decoders 61, 63 are applied to one input leg of AND gates 33*x*. The other input leg of each gate 33*x* is tied in common to the output of column incremented 71*x* for that row. Thus, each gate 33*x* with a pulse on both a segment input leg and the column incremented input leg will be enabled, passing a pulse to the gate electrode of matching SCR 31*x*. For the digit "4," gates 33*b*, 33*c*, 33*f*, and 33*g* are enabled, as are SCRs 31*b*, 31*c*, 31*f*, and 31*g*. This action allows the AC voltage to be applied to bulbs 21*b*, 21*c*, 21*f*, and 21*g*. The pulse on the column incremented input line also energizes column select SCR 43*x*, closing one more link in the circuit. The row select signal pulse will energize the row select SCR 38*x* of all the digit illumination boards 90*x* of the selected row only, finally completing the circuit from common ground return to the AC voltage through the selected light bulbs, causing them to be illuminated. Once an SCR has been energized, it will remain so energized until the AC voltage is removed, thus holding all previously illuminated numeral segments in the On position. The AC voltage is normally not removed until the display board 80 is completely reset by the operator. The AND gates 33*x* on the segment input lines are to prevent the most recent segment signals present on the lines from changing the configuration established by a preceding digit.

Simultaneously with the illuminating of the light bulbs on a coordinate position row, the same row select signal is fed from row combiner gate 41 to the SCR 38S on each of the digit illumination boards 90S of the "S," sequential, row. In this manner, any selected number is displayed in both its coordinate (86) and its sequential (82) positions, simultaneously. Thus, one look at the display board 80 tells the viewer which row-number pairs (section 86) have been called out by the operator, and the sequence (section 82) in which they were called. Of course, the selection sequence within each row is obviously left to right.

Referring to FIG. 9 for a more detailed explanation of the operation of left-hand digit decoder 56, it can be seen that the presence of a pulse on any one of the fifteen output lines from the column decoder 64 is passed through the particular OR gate 79*x* to which that line is connected. For instance, a pulse on any of the lines $A through $F would pass through OR gate 79F to one input leg of AND gate 81G. The other required input to AND gate 81G is from the "N" output line of the Row Decoder 62. Thus, an "N" pulse and a $D pulse would result in an output pulse from AND gate 81G which would go through OR gate 87C to the left-hand segment decoder 61 to generate the digit "4" for display as the left-hand digit 88 for game numbers in the forties. The "N" signal is also used in AND gate 81F to create a "3" digit for game numbers in the thirties.

The generation of the remaining digits used in the left-hand digit location 88 is accomplished in a similar manner. In the embodiment described and illustrated, only the digits "0" through "7" are utilized in the left digit 88 because the exemplary game being described only uses the numbers one through seventy-five. Obviously, other formats and embodiments can be utilized within the concept and scope of the present invention.

The operation of the right-hand digit decoder circuit is best explained with reference to FIG. 10. The right-hand digit 89 uses all ten of the conventional numerals zero through nine. FIG. 10 is a block diagram of the circuit in which signals from the row and column decoders are transformed into the right-hand digit 89 of the two-digit display. A "B" or an "N" or an "O" signal from Row Decoder 62 is sent through OR gate 59 to one of the input pins on each of ten AND gates 53A through 53J, as identified by the Boolean algebra notation B+N+O, which is read "B or N or O." Boolean algebra notation utilizes the mathematical symbols for addition to represent a logic OR function and the symbols for multiplication to represent a logic AND. A signal on either the "I" or the "G" line goes from OR gate 55 to the remaining ten AND gates 15A–J.

The process of deriving the digit "3" of "N 43" for display in the right side half 89 of the two-digit display in any of the fifteen columns is typical of the manner in which the other nine right digits is derived. At AND gate 53C, the signal B+N+0 and $D, from the $3+$D OR gate, together create an output signal pulse which passes through OR gate 51C to cause segment decoder 63 to activate the segment lines appropriate for the digit "3." For a row signal of "B or N or 0," the output digit would be the 3 of 03, 13, 33, 43, 63, or 73. For a row signal of "I" or "G," the output digit would be the 3 or 23 or 53. Similarly, the signals $7 and I or G produce the 2 for 22 or 52, while either $2 or $C, together with that for a B or N or O generates the 2 for 02, 12, 32, 42, or 72.

The column incremented circuit can best be explained with reference to the block diagram of FIG. 11, wherein it will be seen that the "b" and "c" segment signals are applied to the digit detector OR gate 65. Because either a "b" or a "c" segment is common to every seven segment digit, the presence of one of these pulses indicates the presence of a digit to be displayed. When a pulse is present on one of the input legs of OR gate 65 for a particular row, then an output pulse is generated, which is applied to an input of AND gate 17. When a row select pulse from row decoder 62 is present on the other input leg of AND gate 17, an output pulse is generated by that device, likewise. Thus, it can be seen that both a row select signal and a digit present signal are required to generate an output pulse from AND gate 17. When both of these signals are input to AND gate 17, that gate will send an output pulse to the CLOCK input of "D" type flip-flop 67. Because DC is wired to the D input of flip-flop 67, every output pulse of gate 17 will "clock" this "high" logic level to the Q output. The Q output signal goes to one input of all the AND gates 85*x* and to shift register 69. Thus, the first Q output pulse enables the AND gates and generates an output on the "1" line of the shift register which goes to the other input of AND gate 85A. With a signal on both inputs, this gate is enabled and passes a pulse out to the column select SCR of the digit illumination board 90*x*. The next segment pulse arriving at the column incremented board would enable the "2" line, along with gate 85B. Thus, each column board is turned On with a particular configuration and left, with the output selector incrementing to the next position. The circuit can be set so that, after the fifteenth column has been activated, changes to the display can be made to cease until the board is reset, or to start over again at the first column with the sixteenth number.

If the latter method is preferred, the last fifteen numbers called by the game operator will be displayed in a continuously updated fashion at all times, the latest one called replacing the number previously displayed in the left-hand most column, with all the other displayed digits moving one place to the right.

The block diagram for row name light illumination circuit 73*x* is shown in FIG. 12. The 115 Volts AC potential is present at the point indicated when power switch 49 is turned On. SCR 37*x* is fired by the presence on its gate electrode of the appropriate row select pulse from row decoder 62 or row combiner gate 41. When SCR 37*x* is fired once, bulb 36*x*, behind the transparent outline section of the face plate, will illuminate and remain so until the circuit is reset.

Figure 14:
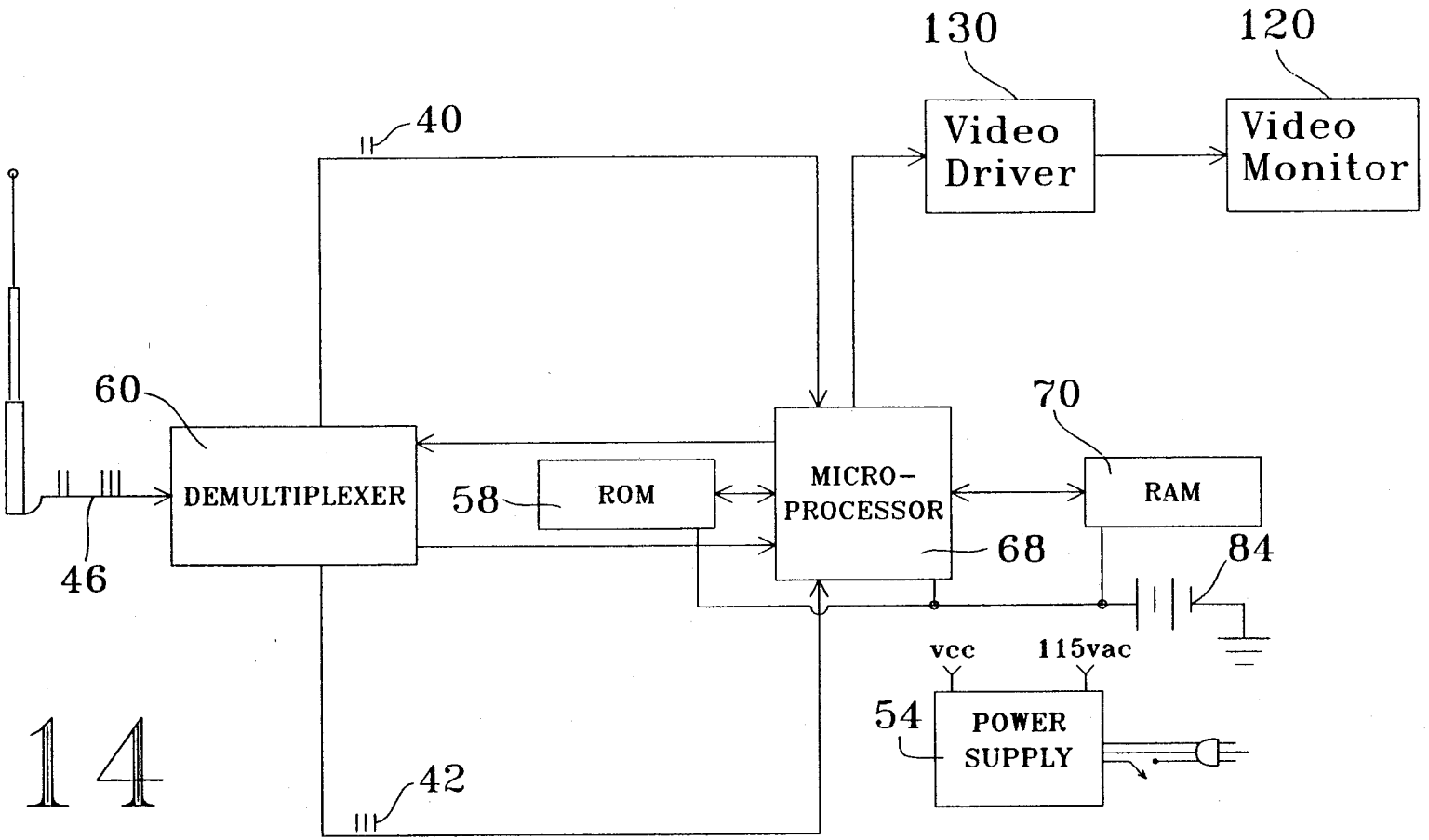
FIG. 14 is a block diagram of an alternate embodiment of a receiver circuit which can be used as part of the present invention.

In an alternative embodiment, the row coordinate data and sequential data are displayed on video monitor 120. In FIG. 14, the combined serial pulse train 46 is shown being received by receiver 52. After this pulse train has been demultiplexed at 60, row pulse train 40 and column pulse train 42 are fed to the microprocessor 68 for processing, storage in Random Access Memory (RAM) 70, and then on to video driver 130. The pulse train data entered into microprocessor 68 is sent to RAM 70 and stored so that if a power failure should occur, microprocessor 68 and the "keep-alive" battery 84 will ensure that the data in RAM 70 is saved. After power has been restored, "Cancel Replay/Restore Board" switch 24 on the console 12 can be activated to send the "restore" pulse train signal to the microprocessor 68 so it will return the video display 120 to the status existing at the time of the power outage. Read Only Memory (ROM) 58 contains the previously stored program of commands which controls the actions of microprocessor 68. Power supply 54 supplies the five Volts DC for the entire video display 120, and also all the 115 Volts AC, which is switched by an internal relay, not shown. Power for video display 120 is supplied through the power on/off switch 49.

The pulse train data that are entered into microprocessor 68 are converted back into the corresponding row coordinate data which is then fed into an appropriate video driver 130. Video driver 130 is preferably a video graphics array (VGA) card which in turn processes the data into a graphical representation of the row coordinate and sequential data which is displayed on a compatible VGA monitor. It will be of course understood that any available graphics adapter such as a Hercules graphics adapter (HGA), Hercules color graphics adapter (HCGA), color graphics adapter (CGA), enhanced graphics adapter (EGA) or their equivalents or any later generation graphics adapter coupled with a compatible video monitor will be suitable.

Simultaneously with graphical presentation of the coordinate position row, the selected number is displayed in both its coordinate (86') and its sequential (82') positions, simultaneously. Thus, one look at video display 120 tells the viewer which row-number pairs (section 86') have been called out by the operator, and the sequence (section 82') in which they were called. Of course, the selection sequence within each row is obviously left to right.

In order to successfully operate the game displaying device, several manually operated switches have been provided. In a preferred embodiment, six switches are installed on the console 12 and one on the receiver 52. Switch 25 on the console 12 and switch 49 on the receiver 52 are Power On/Off switches for their respective locations.

Switch 26 on the console 12 is the Cancel Last Entry switch, by means of which an inadvertent entry, such as a ball dropped in the wrong hole, for instance, can be erased. Switch 27 is the Replay Sequence/Check Switch by means of which all claims or misunderstandings can be settled. Turning this switch to the On position suspends regular play by switching the microprocessor into a reverse, one-step-at-a-time mode. While in this mode, each number previously entered will be displayed in reverse sequence by operating the Next switch 29 to step from one number to the next. At the conclusion of this check, or following any power outage, the Cancel Replay/Restore Board switch 24 is used to restore the display board 80 or video display 120 to the configuration it was in at the time of the interruption, and reinitiate play. The Reset/Clear Board switch 28 is used to restore all circuits to zero and begin a new round of play.

Thus, from the foregoing detailed description, it will be recognized that a device for playing a plurality of games simultaneously has been provided.

While a preferred embodiment of a device constructed in accordance with various features of the present invention has been described herein, it will be understood that no attempt has been made to limit the device to such description. Rather, such description has been intended to embody all possible variations and alternate constructions falling within the spirit and scope of the invention as defined in the appended claims.

Accordingly, this invention is limited only by the claims appended hereto, and their equivalents, when taken in combination with the complete description contained herein.

I claim:

1. A device for displaying numerical digits in both a coordinate location area, and in a sequence of selection order area, together with a control unit and electronic circuitry appropriate to the encoding, sending, receiving, and decoding of data representative of said digits, comprising:

an operator's console fitted with a plurality of receptacles uniquely identified by row-column coordinates for receiving objects with encoded identification markings imprinted thereon, said markings corresponding to said uniquely identified receptacles;

means for generating unique coordinate location data upon receipt of said objects in said receptacles;

means for automatically registering both said unique coordinate location identification data and sequential occurrence data of selected said encoded objects automatically upon deposit of said encoded objects into said corresponding uniquely identified receptacle on said console;

data encoding means for preparing said coordinate location and sequential data for transmission;

means for transmitting said encoded coordinate location and sequential data between said data encoding means and a receiver;

means for receiving and decoding said transmitted coordinate and sequential data into displayable information; and at least one display means for displaying said displayable information in both a coordinate location order portion and in a sequential order.

2. The device of claim 1 wherein said at least one display means comprises:

at least one display board for displaying said displayable information consisting of numerical digit indicating portions, which digit portions, when selected, are illuminated in both a coordinate location order portion of said at least one display board, and in a sequential order of selection portion of said at least one display board; and means for selectively activating multiple light bulb portions of said display board, said light bulb portions revealing, when lighted, patterns which correspond with said numerical digits represented by said decoded coordinate location and sequential data.

3. The device of claim 1 wherein said display means comprises a video driver and a video monitor for graphically displaying said displayable information in both a coordinate location order and in a sequential order.

4. The device of claim 1 wherein said transmitting means comprises direct connection of coaxial cable as signal carrying media between said data encoding means and said receiving means.

5. The device of claim 1 wherein said transmitting means comprises direct connection of fiber-optic cable as signal carrying media between said data-encoding means and said receiving means.

6. The device of claim 1 wherein said means for automatically registering said coordinate location and sequential data comprises a plurality of infra-red light emitter-receiver sets, said objects interrupting said infra-red light.

7. The device of claim 1 wherein said means for automatically registering said coordinate and sequential data comprises a plurality of mechanically operated electrical switches operated by said objects.

8. The device of claim 1 wherein said means for automatically registering said coordinate and sequential data comprises a plurality of proximity operated electronic switches operated by said objects.

9. A game-playing system and devices, comprising:

a plurality of light weight objects encoded with row and column coordinate location figures imprinted thereon;

means for randomly and automatically isolating and selecting one individual ball of said encoded objects; an operator's console fitted with a plurality of receptacles uniquely identified by said row-column coordinates and provided for the receiving of said encoded objects, said uniquely identified receptacles corresponding to matching markings on said encoded objects;

means for generating unique coordinate location data upon receipt of said objects in said receptacles;

means for automatically registering both the unique coordinate location identification data and the sequential occurrence data of selected said encoded objects automatically upon the deposit of said encoded objects into the appropriate said receptacle on said console;

data-encoding means for preparing said coordinate and sequential data for transmission;

means for transmitting said encoded coordinate and sequential data between said data encoding means and a receiver;

means for receiving and decoding said transmitted coordinate and sequential data into displayable information; and at least one video display means having a video driver and a video monitor for graphically displaying said displayable information in both a coordinate location order and in a sequential order.

10. The device of claim 9 wherein said means for registering said coordinate location and sequential occurrence data for selected balls and said means for transmitting said data comprises a computer and associated keyboard, together with appropriate interface means for effecting satisfactory interfaces with other devices and circuits.

* * * * *